United States Patent [19]

Budzich

[11] 4,436,020

[45] Mar. 13, 1984

[54] DUAL INPUT PRESSURE COMPENSATED FLUID CONTROL VALVE

[75] Inventor: Tadeusz Budzich, Moreland Hills, Ohio

[73] Assignee: Caterpillar Tractor Company, Peoria, Ill.

[21] Appl. No.: 357,036

[22] Filed: Mar. 11, 1982

[51] Int. Cl.[3] ..... F15B 13/04

[52] U.S. Cl. ..... 91/446; 91/421; 137/596; 137/596.1; 137/596.13

[58] Field of Search ..... 91/421, 446; 137/596, 137/596.1, 596.13

[56] References Cited

U.S. PATENT DOCUMENTS

| | | | |
|---|---|---|---|
| 3,150,685 | 9/1964 | Lohbauer et al. | 137/596.13 |
| 3,977,301 | 8/1976 | Kroth et al. | 137/596.13 X |
| 4,180,098 | 12/1979 | Budzich | 137/596.13 |
| 4,282,898 | 8/1981 | Harmon et al. | 137/596.13 |

*Primary Examiner*—Gerald A. Michalsky

*Attorney, Agent, or Firm*—Sixbey, Friedman & Leedom

[57] ABSTRACT

A fully compensated direction flow control valve for control of positive and negative loads provided with a direction control and flow metering spool and a control which varies the level of the pressure differential controlled across the metering section of the spool in respect to the displacement of the spool from its neutral position.

10 Claims, 1 Drawing Figure

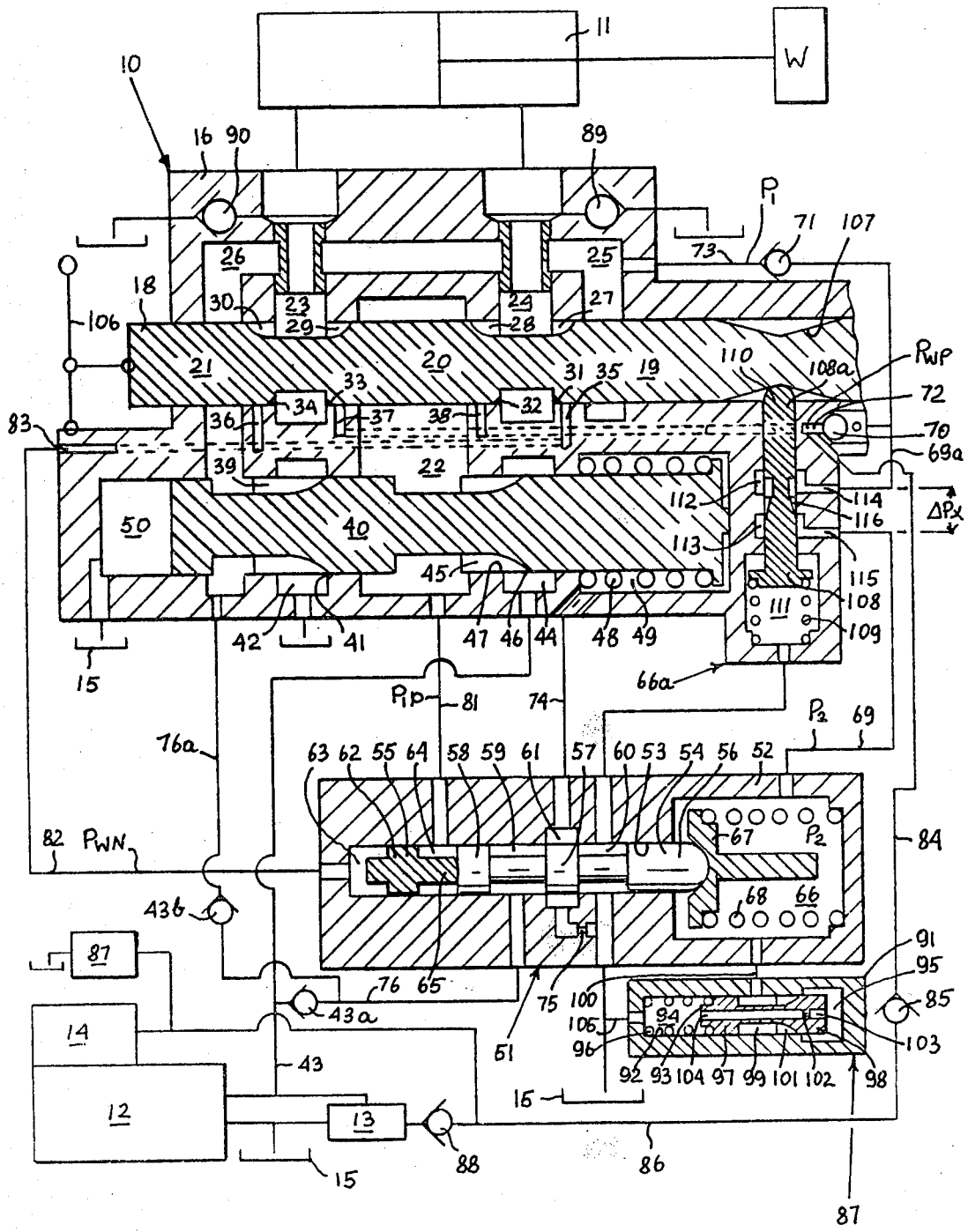
W
10
11
16
90
89
P1
71
107
73
26
25
18
30
23
29
24
28
27
106
21
20
33
31
35
19
110
108a
PWP
72
83
36
34
37
38
32
70
69a
39
22
112
114
116
ΔPx
50
40
113
115
45
111
108
109
42
41
47
46
44
48
49
15
66a
PIP
81
74
P2
69
76a
63
62
55
64
58
59
61
57
60
53
54
56
52
82
PWN
67
P2
84
43b
68
66
87
91
95
76
65
75
100
85
43a
14
105
94
51
96
103
43
92
93
104
97
99
101
102
98
12
13
15
88
86
87

DUAL INPUT PRESSURE COMPENSATED FLUID CONTROL VALVE

BACKGROUND OF THE INVENTION

This invention relates generally to fluid control valves provided with positive and negative load compensation.

In more particular aspects this invention relates to pressure compensated direction and flow control valves, the positive and negative load compensators of which are controlled by a single amplifying pilot valve stage.

In still more particular aspects this invention relates to pilot operated pressure compensated controls of direction control valves, used in control of positive and negative load, which permit variation in the level of control differential across metering orifices of the valve spool, while this control differential is automatically maintained constant at each controlled level.

In still more particular aspects this invention relates to pilot operated pressure compensated controls of a direction control valve which vary the level of the pressure differential across the metering orifice of the valve in response to the position of its valve spool.

Closed center fluid control valves, pressure compensated for control of positive and negative loads, are desirable for a number of reasons. They permit load control with reduced power losses and therefore, increased system efficiency. They also permit simultaneous proportional control of multiple positive and negative loads. Such fluid control valves are shown in my U.S. Pat. No. 4,180,098, issued Dec. 5, 1979 and also in my U.S. Pat. No. 4,222,409 issued Sept. 16, 1980. However, the valves of those patents, although capable of proportional control of positive and negative loads, use for such control the energy directly transmitted through the load pressure sensing ports, which not only attenuate the control signals, but limit the response of the control. Those valves also automatically maintain a constant pressure differential across metering orifices irrespective of the magnitude of the fluid flow in control of both positive and negative loads.

SUMMARY OF THE INVENTION

It is therefore a principal object of this invention to provide an improved control of pressure compensated valve, which varies its control pressure differential with the displacement of the valve spool while this pressure differential is automatically maintained constant at each specific level.

Another object of this invention is to provide an improved control of pressure compensated valve which increases the control pressure differential proportionally to the displacement of the valve spool from its neutral position.

It is a further object of this invention to provide an improved control of pressure compensated valve, which permits the fluid flow to vary in respect to the valve spool displacement in any desired way, without altering the flow characteristics of the metering slots of the valve.

Briefly the foregoing and other additional objects and advantages of this invention are accomplished by providing novel pressure compensated controls of a direction control valve which automatically vary the level of the controlled pressure differential maintained across its metering orifices with the displacement of its valve spool from neutral position, during control of both positive and negative load. In this way a low pressure differential can be used at low flow levels, providing high accuracy of the control, while a much higher pressure differential can be used at high flow levels, permitting high rated flow of the valve at very high average efficiency level. The controlled flow through the valve can be varied, in any desired way, in respect to the displacement of the valve spool, without changing the configuration of the metering slots, for optimum performance of the valve.

Additional objects of this invention will become apparent when referring to the preferred embodiments of the invention as shown in the accompanying drawing and described in the following detailed description.

DESCRIPTION OF THE DRAWING

The single FIGURE is a sectional view of an embodiment of a flow control valve provided with a single positive and negative load compensator, also showing a longitudinal sectional view of an embodiment of a pilot valve amplifying stage controlling the compensator and longitudinal sectional view of a control signal modifying control with fluid motor, system pump and other system valves shown schematically.

DESCRIPTION OF THE PREFERRED EMBODIMENT

Referring now to the drawing, an embodiment of a flow control valve generally designated as 10, is shown interposed between diagrammatically shown fluid motor 11 driving load W and a pump 12, of a fixed displacement or variable displacement type, driven by a prime mover, not shown. Fluid flow from the pump 12 to flow control valve 10 and a circuit of diagrammatically shown flow control valve 13 is regulated by pump flow control 14. If pump 12 is of a fixed displacement type, pump flow control 14 is a differential pressure relief valve, which, in a well known manner, by bypassing fluid from pump 12 to a reservoir 15, maintains discharge pressure of pump 12 at a level, higher by a constant pressure differential, than load pressure developed in fluid motor 11. If pump 12 is of a variable displacement type, pump flow control 14 is a differential pressure compensator, well known in the art, which by changing displacement of pump 12, maintains discharge pressure of pump 12 at a level, higher by a constant pressure differential, than load pressure developed in fluid motor 11.

The pump flow control 14 may also be a maximum pressure compensator or relief valve, which maintains the discharge pressure of the pump 12 at a maximum constant pressure level during operation of the system.

The flow control valve 10 is of a four way type and has a housing 16 provided with a bore 17, axially guiding a valve spool 18. The valve spool 18 is equipped with lands 19, 20 and 21, which in neutral position of the valve spool 18, as shown in the drawing isolate a fluid supply chamber 22, load chambers 23 and 24 and outlet chambers 25 and 26. Lands 19, 20 and 21, of valve spool 18, are provided with metering slots 27, 28, 29 and 30 and signal slots 31, 32, 33 and 34. Negative load sensing ports 35 and 36 are positioned between load chambers 23 and 24 and outlet chambers 26 and 25. Positive load sensing ports 37 and 38 are located between supply chamber 22 and load chambers 23 and 24. Negative load throttling slots 39, of control spool 40, equipped with throttling edges 41, connect outlet chambers 26 and 25 with an exhaust chamber 42, which in turn is connected to reservoir 15.

The pump 12, through its discharge line 43, is connected to an inlet chamber 44. The inlet chamber 44 is connected through positive load throttling slots 45, on control spool 40, provided with throttling edges 46, with the fluid supply chamber 22. Bore 47 axially guides the control spool 40, which is biased by control spring 48, contained in control space 49, towards position as shown. The control spool 40 at one end projects into control space 49, the other end projecting into chamber 50, connected to the reservoir 15. A pilot valve assembly, generally designated as 51, comprises a housing 52, provided with a bore 53, slidably guiding pilot valve spool 54 and free floating piston 55. The pilot valve spool 54 is provided with lands 56, 57 and 58, defining annular spaces 59 and 60. Annular space 61 is provided within the housing 52 and communicates directly with bore 53. The free floating piston 55 is provided with a land 62, which defines annular spaces 63 and 64 and is provided with extension 65, selectively engageable with land 58 of the pilot valve spool 54. The pilot valve spool 54 at one end projects into control space 66 and engages, with its land 56 and spring retainer 67, a pilot valve spring 68. Control space 66 communicates through line 69 and a controller, generally designated as **66*a*, and through line 69*a* with check valves 70 and 71. The check valve 70 is connected by passage 72 with positive load sensing ports 37 and 38. The check valve 71 communicates through line 73 with the outlet chamber 25. Annular space 61, of the pilot valve assembly 51, communicates through line 74 with control space 49 and also communicates, through leakage orifice 75, with annular space 60, which in turn is connected to reservoir 15. Annular space 59 communicates through line 76 and check valve 43*a* with discharge line 43 while also communicating through check valve 43*b* and line 76*a* with the outlet chamber 26. Annular space 64 is connected by line 81 with supply chamber 22. Annular space 63 is connected by line 82 and passage 83 with negative load sensing ports 36 and 35. Positive load sensing ports 37 and 38 are connected through passage 72, line 84 and a check valve 85 and a signal line 86 with the pump flow control 14. Control space 66 is connected through a flow control, generally designated as 87, with the reservoir 15. Flow control 87 is a flow control device, passing a constant flow from control space 66 to the reservoir 15. The load chambers 23 and 24 are connected, for one way fluid flow, by check valves 89 and 90, to schematically shown system reservoir, which also might be a pressurized exhaust manifold of the entire control system, as shown in the drawing. The flow control, generally designated as 87, is interposed between control space 66 and the system reservoir 15 and comprises a housing 91, provided with a bore 92, guiding a flow control spool 93, which defines spaces 94 and 95 and which is biased by a spring 95. The flow control spool 93 is provided with lands 97 and 98, defining annular space 99, which is connected by line 100 with control space 66. The flow control spool 93 is also provided with throttling slots 101 and leakage orifice 102, which communicates through passages 103 and 104, space 95 with space 94, space 94 being connected by line 105 with system reservoir 15**.

The valve spool 18 at one end is connected to a manual lever 106, while at the other end its land 19 is provided with a cam surface 107. A metering spool 108, guided in a bore **108*a* provided in the housing 16, is biased by a spring 109 towards engagement by its spherical end 110 with the cam surface 107. The other end of the metering spool 108 projects into space 111, connected to system reservoir 15. Bore 108*a* is provided with two annular spaces 112 and 113. Space 112 communicates through port 114 and line 69*a* with check valves 70 and 71. Space 113 communicates through port 115 and line 69 with control space 66. Metering slots 116 on the metering spool 108 connect for metered fluid flow annular spaces 112 and 113**.

The preferable sequencing of lands and slots of valve spool 18 is such, that when displaced in either direction from its neutral position, as shown in the drawing, one of the load chambers 23 or 24 is connected by signal slot 32 or 33 to the positive load sensing port 37 or 38, while the other load chamber is simultaneously connected by signal slot 31 or 34 with negative load sensing port 35 or 36, the load chamber 23 or 24 still being isolated from the supply chamber 22 and outlet chambers 25 and 26. Further displacement of valve spool 18 from its neutral position connects load chamber 23 or 24 through metering slot 28 or 29 with the supply chamber 22, while simultaneously connecting the other load chamber through metering slot 27 or 30 with outlet chamber 25 or 26.

As previously described the pump flow control 14, in a well known manner, will regulate fluid flow, delivered from pump 12, to discharge line 43, to maintain the pressure in discharge line 43 higher, by a constant pressure differential, than the highest load pressure signal transmitted through the check valve system to signal line 86. Therefore, with the valve spool 18, of flow control valve 10, in its neutral position blocking positive load sensing ports 37 and 38, signal pressure input to pump flow control 14 from signal line 86 will be at minimum pressure level, corresponding with the minimum standby pressure of the pump 12.

As shown in the drawing, the flow control valve 10 is interposed between a schematically shown pump 12 and the fluid motor 11. The pilot valve assembly 51, in a manner as will be described later in the text, regulates the position of the control spool 40 to control the pressure differential $\Delta Pyp$ developed across orifices created by displacement of metering slots 28 and 29 and to control the pressure differential $\Delta Pyn$, across orifices created by displacement of metering slots 27 and 30. Control space 66 of the pilot valve assembly 51 is connected to the system reservoir 15 by the flow control, generally designated as 87, which is a constant flow device, passing a constant flow of fluid from control space 66 to the reservoir 15, irrespective of the magnitude of control pressure P2, in a manner as will be described later in the text. This constant flow of fluid passes through the controller **66*a*, which is interposed between the control pressure sensing circuit of flow control valve 10 and control space 66 of the pilot valve assembly 51. In a well known manner, for each specific position of the metering spool 108 a constant pressure differential, equal to $\Delta Px$ will be developed across the controller 66*a*. it is assumed, when describing the operation of the flow control valve of this invention, that with the metering spool 108 displaced by the cam surface 107** all the way down, the pressure differential $\Delta Px$ becomes so small that the value of control pressure P2 approaches the value of Pwp or P1 pressure.

Assume that the valve spool 18 is displaced by the manual lever 106 from left to right by a sufficient amount to connect with signal slot 33 the load chamber 23 with positive load sensing port 37, while the load chamber 23 is still isolated from the supply chamber 22. Assume also that the load chamber 23 is subjected to a positive load pressure Pwp. The load pressure Pwp transmitted to passage 72 will open the check valve 70, close the check valve 71 and will be transmitted through line 69*a* to the controller 66*a*. Assume that the resistance to flow of metering grooves 116 of the metering spool 108 is such that the pressure drop ΔPx due to constant flow through flow control section 87 becomes negligible. The load pressure Pwp will be then directly transmitted to control space 66 with P2 becoming Pwp pressure. Control space 66 is connected through the flow control section 87 with the system reservoir 15. In a well known manner, the flow control spool 93 will automatically assume a throttling position, throttling the fluid from control space 66 at Pwp or P2 pressure, by action of throttling slots 101, to a pressure, equivalent to the preload of spring 96. Therefore space 95 will be always maintained at a constant pressure as dictated by the preload in the spring 96. Space 95 is connected through passage 103, leakage orifice 102 and passage 104 with space 94, connected to system reservoir 15 by line 105. Therefore, with constant pressure differential automatically maintained across leakage orifice 102, a constant flow, at a certain preselected minimum level, will take place from space 95 and control space 66, irrespective of the level of Pwp or P2 pressure. With the controller 66*a* providing minimum resistance to flow, P2 pressure will always equal Pwp pressure. The pilot valve spool 54 is subjected to Pwp pressure in the control space 66, preload of the pilot valve spring 68 and pressure P1p in annular space 64, which is connected by line 81 to the supply chamber 22, which in turn is connected, through throttling slots 45, with the inlet chamber 44, connected by discharge line 43 to the pump 12. Under the action of those forces the pilot valve spool 54 will move into a modulating position, as shown in FIG. 1, regulating the pressure in the control space 49 and therefore position of the control spool 40, throttling by throttling edges 46 the fluid flow from the inlet chamber 44 to the supply chamber 22, to maintain a constant pressure differential between annular space 64 and control space 66, equivalent to preload of the pilot valve spring 68. The free floating piston 55, subjected to pressure differential between anular spaces 64 and 63, will move all the way to the left, out of contact with the pilot spool 54. Since the supply chamber 22 is closed by position of the valve spool 18 from the load chamber 23 the control spool 40 will assume a position, in which throttling edges 46 will completely isolate the inlet chamber 44 from the supply chamber 22.

Assume that the valve spool 18 is further displaced by the manual lever 106 from left to right, creating a metering orifice of specific area between the supply chamber 22 and the load chamber 23 through metering slot 29. Assume also that the load chamber 23 is subjected to a positive load pressure Pwp. Fluid flow will take place from the supply chamber 22, through created metering orifice, to the fluid motor 11, the pilot valve assembly automatically throttling, through the position of the control spool 40, the fluid flow from the inlet chamber 44 to the supply chamber 22, to maintain across created metering orifice a constant pressure differential of ΔPyp equal to ΔP, which in turn is equal to the quotient of the preload of the pilot valve spring 68 and the cross-sectional area of the pilot valve spool 54. Since a constant pressure differential is maintained across created metering orifice a constant flow of fluid will be supplied to fluid motor 11, irrespective of the variation in the magnitude of the load W. Therefore under those conditions the flow to the fluid motor 11 becomes directly proportional to the flow area of the created metering orifice and independent of Pwp pressure.

Assume that while controlling a positive load W, in a manner as described above, the resistance to constant flow of the metering slots 116 of the metering spool 108 of the controller 66*a* was suddenly increased with metering spool 108 moved into position, as shown in the drawing. Assume also that due to resistance a pressure differential ΔPx is developed between annular spaces 112 and 113 of the controller 66*a*. Then the control space 66 will be subjected to P2 pressure which is equal to the difference between Pwp pressure and ΔPx. It can be seen that ΔPyp=P1p−Pwp, which is the pressure differential through created metering orifice, P1p−P2=ΔP, which is the constant pressure differential caused by the preload of the pilot valve spring 68 and that Pwp−P2=ΔPx. From the above three equations, when substituting and eliminating P1p, Pwp and P2 pressures, the basic relationship of ΔPyp=ΔP−ΔPx is obtained. With ΔPx=0 which is the case, as explained above, when controller 66*a* is in its fully open position, ΔPyp=ΔP and the flow through the created metering orifice to the fluid motor is controlled at maximum constant pressure differential. Any value of ΔPx as can be seen from the basic equation, will automatically lower, by the same amount, ΔPyp, acting across created metering orifice, automatically reducing the quantity of fluid flow to the fluid motor 11, this flow still being maintained constant at a constant level and independent of the variation in the magnitude of load W. Therefore, by controlling the value of ΔPx, by the action of controller 66*a*, the pressure differential ΔPyp is controlled, controlling the velocity of load W. In a similar way the velocity of the load W and therefore the flow into the fluid motor 11 can be controlled by the variation in the area of the orifice created by displacement of the valve spool 18, at any controlled level of ΔPyp, as dictated by the value of ΔPx. The value of ΔPx is varied in respect to displacement of the valve spool 18 by displacement of the metering spool 108 through the action of the cam surface 107. In the neutral position of valve spool 18, as shown in the drawing, the orifice area of the metering slots 116 is minimum corresponding to the maximum value of ΔPx and therefore minimum value of ΔPyp. The displacement of the valve spool 18 from its neutral position moves the metering spool 108 downward gradually increasing the effective area of the metering slots 116, reducing the value of ΔPx and therefore increasing the value of ΔPyp. The configuration of the cam 107 is such that the control pressure differential ΔPyp at small displacements of valve spool 18 from its neutral position is small gradually increasing with the displacement of the valve spool 18, the maximum value of ΔPyp corresponding to maximum displacement of the valve spool 18 from its neutral position.

Assume that the valve spool 18 is displaced by the manual lever 106 from left to right by sufficient amount to connect with the signal slot 31 the load chamber 24 with negative load sensing port 35, while the load chamber 24 is still isolated from the outlet chamber 25. Assume also that the load chamber 24 is subjected to a negative load pressure Pwn. Then the pressure signal at Pwn pressure will be transmitted through passage 83 and line 82 to annular space 63 and react on the cross-sectional area of the free floating piston 55. Assume also that with communication between the load chamber 24 and the outlet chamber 25 closed no pressure signal is transmitted through line 69*a* and that control space 66 is subjected to reservoir pressure, by the action of the flow control section 87. The pilot valve spool 54 will be displaced by the free floating piston 55 all the way to the right, connecting annular space 61 and the control space 49 with annular space 59, subjected to pump discharge pressure through line 76. The control spool 40 will automatically move all the way from right to left, with the throttling edges 41 cutting off communication between the exhaust chamber 42 and the outlet chamber 26 and therefore isolating outlet chambers 25 and 26 from the system reservoir 15.

Assume that the valve spool 18 is further displaced by the manual lever 106 from left to right, creating a metering orifice of specific area between the load chamber 24 and the outlet chamber 25, subjected to negative load pressure Pwn. Assume also that the area of the metering slots 116 is such that the pressure drop ΔPx, induced by the regulated flow through the flow control 87, will be negligible. With the control spool 40 blocking the outlet chamber 26 from the exhaust chamber 42, the negative load pressure will be automatically transmitted through line 73, will open the check valve 71, close the check valve 70 and will be transmitted through line 69*a*, the controller 66*a* and line 69 to control space 66. The P1 pressure in control space 66 will react on the cross-sectional area of pilot valve spool 54, the pilot valve spring 68 bringing it into its modulating position, as shown in the drawing and controlling the pressure in the control space 49, to establish a throttling position of the control spool 40, which will maintain a constant pressure differential across created metering orifice, as dictated by the preload of the pilot valve spring 68. Then Pwn−P2 will equal contant ΔP, which is equal to the quotient of the preload of the pilot valve spring 68 and the cross-sectional area of the pilot spool 54. Since a constant pressure differential of ΔPyn=ΔP is maintained across the created metering orifice, flow out of the fluid motor 11 will be proportional to the area of the created metering orifice and independent of the magnitude of the negative load W. Therefore in this way, by varying the flow area of the metering orifice created by displacement of the valve spool 18, the velocity of the load W can be controlled, each area of orifice representing a specific constant flow level, independent of the magnitude of the load W.

Assume that while controlling a negative load W, in a manner as described above, the resistance to constant flow of the metering slots 116 of the metering spool 108, of the controller 66*a*, was suddenly increased with metering spool 108 moved back into position as shown in the drawing. Assume also that due to the resistance a pressure differential ΔPx is developed between annular spaces 112 and 113 of the controller 66*a*, resulting in ΔPx drop in P1 pressure. Therefore, P1−P2=ΔPx, Pwn−P2=ΔP and Pwn−P1=ΔPyn. When substituting and eliminating P1 and P2 and Pwn pressures, the basic relationship of ΔPyn=ΔP−ΔPx can be established. With ΔPx=0, which is the case with the controller 66*a* in its fully open position, as already described above, ΔPyn assumes its maximum constant value equal to ΔP. With the metering spool 113 in its throttling position, by controlling the value of ΔPx the value of ΔPyn can be controlled from maximum to zero, each constant value of ΔPyn, at any specific flow area of metering orifice created by displacement of the valve spool 18, representing a specific constant flow at a specific level from the fluid motor 11 and independent of the magnitude of the load W. As already mentioned when referring to the positive load control the value of ΔPx is varied by the controller 66*a* in respect to displacement of the valve spool 18 from its neutral position. Small displacements of the valve spool 18 from its neutral position correspond to large value of ΔPx and small value of ΔPyn. Large displacements of the valve spool 18 from its neutral position correspond to small values of ΔPx and large values of ΔPyn.

During control of positive load the free floating piston 55 is forceably maintained by a pressure differential out of contact with the pilot valve spool 54. During control of negative load the free floating piston 55 acts together with the pilot spool 54. During control of positive load the pressure differential, across the orifice created by displacement of the valve spool 18, is controlled by the throttling action of positive load throttling slots 45. During control of negative load the pressure differential across the orifice created by displacement of the valve spool 18, is maintained by the throttling action of the negative load throttling slots 39. During the control of both positive and negative loads pressure differential, acting across created metering orifice can be varied by the controller 66*a*.

The displacement of the valve spool 18 in either direction from its neutral position gradually increases the areas of positive load metering orifices 28 and 29 and the negative load metering orifices 27 and 30, while the pressure differential acting across those orifices is gradually increased. Therefore with the control configuration, as shown in the drawing, small orifice areas corresponding to small displacements of valve spool 18 are subjected to small controlled pressure differentials. This results in an extremely sensitive accurate and efficient control where it is most needed and corresponds to small final adjustments in position of the load. With progressively increasing areas of the metering orifices corresponding to the larger displacements the level of the controlled pressure differential is also being gradually increased resulting in large fluid flows through the valve. The conventional manufacturing processes make the control of the orifice area in respect to valve spool displacement very expensive. From the standpoint of performance and stability, the area of the metering orifice, when plotted on the base of valve spool travel, should approximate a logarithmic curve. The metering slots providing such characteristics if feasible at all are very expensive. By introducing another variable and that is variation in the control pressure differential in respect to the valve spool displacement, the metering slots with linear characteristics can produce nonlinear flow of any desired characteristics. In this way for example the flow through the metering orifice having linear area characteristics when plotted on the base of the valve spool displacement can be changed to any desired nonlinear function just by selecting the profile of the cam surface 107. In this way extremely accurate control of the load at small velocities with a large flow potential through a comparatively small valve are made possible at a high average efficiency level.

In the control configuration, as shown in the drawing, the control pressure differential of both positive and negative loads is varied in an identical way in respect to valve spool displacement by a single controller 66*a*. If desired the controller 66*a* can modify the load pressure signals only from the positive load pressure sensing ports and another identical controller actuated by the cam surface 107 can be used to modify the control signals of negative load. In this way by changing the configuration of the metering slots 116 different flow control characteristics can be obtained for control of positive and negative loads, while the positive and negative load controllers are being operated from the same can surface 107.

It is preferable to actuate the metering spool 108 through a cam surface 107, provided on the land 19 of the valve spool 18. In this way in combination with possible selection of the shape of the metering slots 116 great flexibility in selection of the flow characteristics of the valve in respect to its valve spool displacement can be obtained. However, it is recognized that the displacement of the metering spool 108 could be made the same as the displacement of the valve spool 18, the metering spool 108 then becoming an integral part of the valve spool 18.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A control valve assembly operable to control fluid flow to and from a fluid motor subjected to a load, said valve assembly having first valve means operable to meter fluid flow of said motor, throttling control means operable to throttle fluid flow of said motor, pilot valve means having means responsive to a load pressure related control signal and operable through said throttling control means to maintain a relatively constant pressure differential at a preselected constant level across said pilot valve means and to maintain a constant pressure differential across said first valve means during control of said load, and controller means having means responsive to displacement of said first valve means and means operable to modify said load pressure related control signal, whereby the level of said constant pressure differential acting across said first valve means can be varied in respect to displacement of said first valve means while said pressure differential across said pilot valve means remains constant at said constant predetermined level.

2. A control valve assembly as set forth in claim 1 wherein said throttling control means includes positive load throttling control means.

3. A control valve assembly as set forth in claim 1 wherein said throttling control means includes a negative load throttling control means.

4. A control valve assembly as set forth in claim 1 wherein said throttling control means includes positive and negative load throttling control means.

5. A control valve assembly operable to control fluid flow to and from a fluid motor subjected to an opposing or aiding load, said valve assembly having first valve means operable to meter fluid flow to and from said fluid motor, throttling control means operable to selectively throttle fluid flow to and from said fluid motor, pilot valve means having means responsive to a load pressure related control signal and operable through said throttling control means to maintain a relatively constant pressure differential at a preselected constant level across said pilot valve means and to maintain a constant pressure differential across said first valve means during control of said opposing or said aiding load, and controller means having means responsive to displacement of said first valve means and means operable to modify said load pressure related control signal, whereby the level of said constant pressure differential acting across said first valve means can be varied in respect to displacement of said first valve means while said pressure differential across said pilot valve means remains constant at said constant predetermined level.

6. A control valve assembly as set forth in claim 5 wherein said means responsive to displacement of said first valve means includes cam surface means.

7. A control valve assembly as set forth in claim 5 wherein said first valve means has cam means.

8. A control valve assembly as set forth in claim 5 wherein said means operable to modify said load pressure related control signal includes variable flow orifice means and a flow control means down stream of said variable flow orifice means.

9. A control valve assembly as set forth in claim 5 wherein said first valve means has manually operated actuating means.

10. A control valve assembly supplied with pressure fluid by a pump, said control valve assembly comprising a housing having an inlet chamber, a supply chamber, first and second load chambers and exhaust means connected to reservoir means, first valve means for selectively interconnecting said load chambers with said supply chamber and said exhaust means, first control orifice means responsive to movement of said first valve means and operable to meter fluid flow between said supply chamber and said load chambers, second control orifice means responsive to movement of said first valve means and operable to meter fluid flow between said load chambers and said exhaust means, positive load fluid throttling means between said inlet chamber and said supply chamber, negative load fluid throttling means between said load chambers and said exhaust means, pilot valve means operable through said positive load fluid throttling means to throttle fluid flow from said inlet chamber to said supply chamber and also operable through said negative load fluid throttling means to throttle fluid flow from said load chambers to said exhaust means to maintain a constant pressure differential at a preselected constant level across said pilot valve means and to maintain a constant pressure differential across said first or said second control orifice means, and controller means having means responsive to movement of said first valve means operable through said pilot valve means to vary the level of said constant pressure differential across said first and said second control orifice means in relation to displacement of said first valve means, while said pressure differential across said pilot valve means remains constant at said constant predetermined level.

* * * * *